US008938614B2

(12) United States Patent
Fischer et al.

(10) Patent No.: US 8,938,614 B2
(45) Date of Patent: Jan. 20, 2015

(54) MOTOR VEHICLE ELECTRONICS DEVICE, MOTOR VEHICLE, METHOD FOR DISPLAYING DATA ON A MOTOR VEHICLE DISPLAY APPARATUS, AND COMPUTER PROGRAM PRODUCT

(75) Inventors: Jorg Fischer, Berlin (DE); Frank Dietrich, Berlin (DE); Manfred Paeschke, Wandlitz (DE)

(73) Assignee: Bundesdruckerei GmbH, Berlin (DE)

( * ) Notice: Subject to any disclaimer, the term of this patent is extended or adjusted under 35 U.S.C. 154(b) by 146 days.

(21) Appl. No.: 13/120,051

(22) PCT Filed: Jul. 24, 2009

(86) PCT No.: PCT/EP2009/059551

§ 371 (c)(1),
(2), (4) Date: Jul. 6, 2011

(87) PCT Pub. No.: WO2010/031625

PCT Pub. Date: Mar. 25, 2010

(65) Prior Publication Data

US 2011/0264916 A1 Oct. 27, 2011

(30) Foreign Application Priority Data

Sep. 22, 2008 (DE) ..... 10 2008 042 259

(51) Int. Cl.

| | |
|---|---|
| ***H04L 9/32*** | (2006.01) |
| ***G07C 5/08*** | (2006.01) |
| ***G07C 5/00*** | (2006.01) |
| *H04L 29/06* | (2006.01) |

(52) U.S. Cl.

CPC ..... *G07C 5/085* (2013.01); *G07C 5/008* (2013.01)

USPC ..... 713/175; 713/156; 713/157; 713/168

(58) Field of Classification Search

CPC ..... H04L 9/3268

USPC ..... 713/175

See application file for complete search history.

(56) References Cited

U.S. PATENT DOCUMENTS 5,794,164 A * 8/1998 Beckert et al. ..... 455/3.06
2004/0003237 A1 * 1/2004 Puhl et al. ..... 713/156

(Continued)

FOREIGN PATENT DOCUMENTS

DE 20 2004 017458 U1 2/2005
DE 10 2006 015212 A1 10/2007

(Continued)

OTHER PUBLICATIONS

Rankl, Effing: "Handbuch der Chipkarten" 1999, Hanser Verlag, Munchen, XP002552615, p. 201-203.

(Continued)

*Primary Examiner* — Ashok Patel
*Assistant Examiner* — Gary Gracia

(57) ABSTRACT

The invention relates to a motor vehicle electronics device comprising a first interface (116) for establishing a first connection to a first ID token (134) in order to read data from the first ID token, —a memory (104) for storing a certificate, —means (122) for the cryptographic authentication with respect to the first ID token using the certificate, —means (130) for actuating at least one display apparatus (136, 138) for reproducing the data, and —a second interface (118) for storing the certificate in the memory.

18 Claims, 3 Drawing Sheets

(56) References Cited

U.S. PATENT DOCUMENTS

Figure 1:
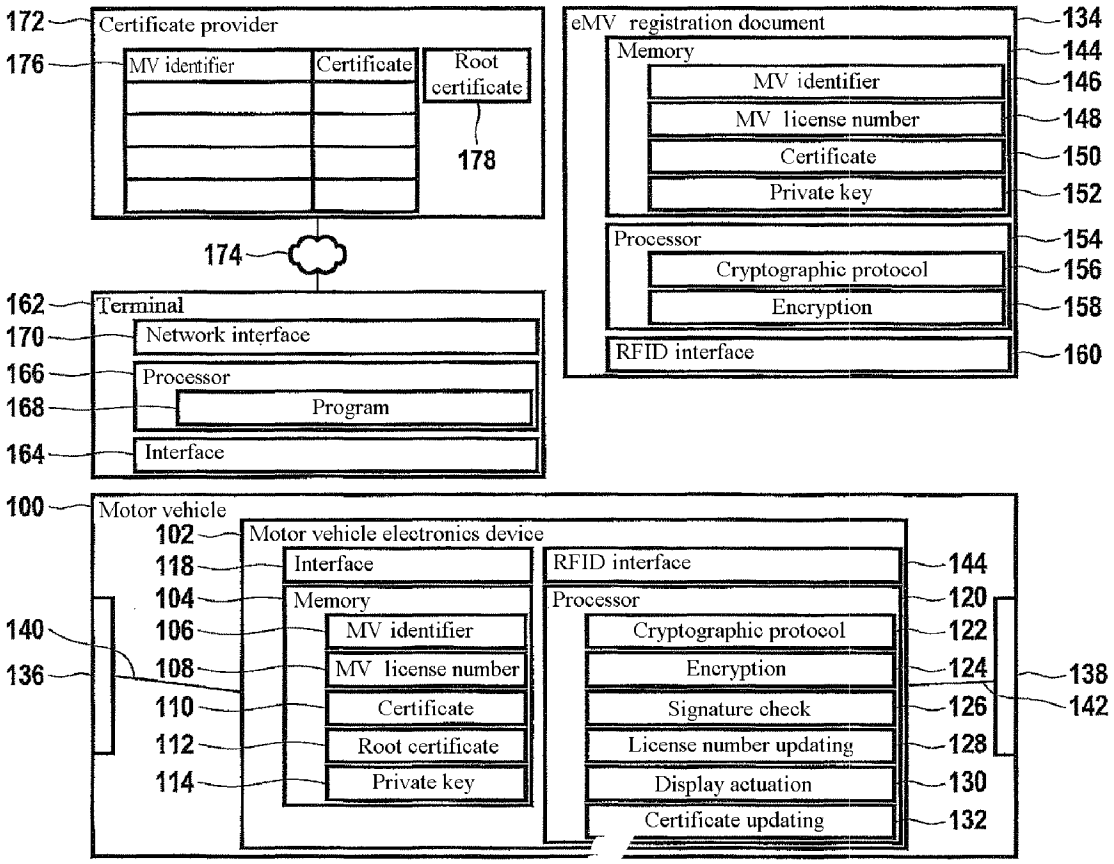

| | | | | |
|---|---|---|---|---|
| 2004/0210757 | A1* | 10/2004 | Kogan et al. | 713/182 |
| 2005/0139664 | A1* | 6/2005 | Yamagiwa | 235/385 |
| 2006/0007003 | A1* | 1/2006 | Yamagiwa | 340/572.1 |
| 2006/0157563 | A1* | 7/2006 | Marshall | 235/382 |
| 2006/0255910 | A1* | 11/2006 | Fukushima et al. | 340/5.65 |
| 2007/0008084 | A1* | 1/2007 | Wu et al. | 340/425.5 |
| 2007/0025553 | A1* | 2/2007 | Beuque et al. | 380/263 |
| 2007/0287415 | A1* | 12/2007 | Yamada | 455/406 |
| 2008/0148374 | A1* | 6/2008 | Spaur et al. | 726/6 |
| 2008/0214165 | A1* | 9/2008 | Matsumura et al. | 455/414.3 |
| 2008/0275991 | A1* | 11/2008 | Matsuzaki et al. | 709/225 |
| 2009/0207004 | A1* | 8/2009 | Ziska et al. | 340/426.1 |
| 2010/0031025 | A1* | 2/2010 | Zhang et al. | 713/156 |
| 2010/0040234 | A1* | 2/2010 | Alrabady et al. | 380/278 |
| 2010/0064136 | A1* | 3/2010 | Longobardi et al. | 713/168 |
| 2010/0066513 | A1* | 3/2010 | Bauchot et al. | 340/426.1 |
| 2010/0073125 | A1* | 3/2010 | Alrabady et al. | 340/5.2 |

FOREIGN PATENT DOCUMENTS

| | | | |
|---|---|---|---|
| DE | 10 2006 025023 | A1 | 11/2007 |
| DE | 10 2006 027253 | A1 | 12/2007 |
| DE | 10 2008 042582 | A1 | 10/2008 |
| EP | 1349032 | B1 | 10/2003 |
| WO | WO 2005/093668 | A | 10/2005 |

OTHER PUBLICATIONS

Wobst: "Abenteuer Kryptologie" 2001, Addison-Wesley, Munchen, XP002552616, p. 295; figure 6.5.

Rankl, W., u.a.: Handbuc der Chipkarten, 3, Auflage, ISBN 3-446-21115-2, Carl Hanser Verlag Munchen Wien, 1999 S. 187-203.

Rexha, B.: Increasing user privacy in online transactions with X.509 v3 certificate private extensions and smartcards. Proceedings of the Seventh IEEE International Conference on E-Commerce Technology, 2005.

* cited by examiner

MOTOR VEHICLE ELECTRONICS DEVICE, MOTOR VEHICLE, METHOD FOR DISPLAYING DATA ON A MOTOR VEHICLE DISPLAY APPARATUS, AND COMPUTER PROGRAM PRODUCT

The invention relates to a motor vehicle electronics device, a motor vehicle, a method for displaying data on a motor vehicle display apparatus and a computer program product.

From U.S. Pat. No. 5,657,008, an electronic motor vehicle license number is known in which a vehicle identification number is stored. The vehicle identification number is used for checking whether the electronic motor vehicle license number also actually belongs to the motor vehicle to which it is attached.

From WO 2007/137555 A2, an electronically configurable motor vehicle license number with a display is known. In order to configure the motor vehicle license number, data are assembled in an external configuration unit and encrypted. The encrypted data are sent out as infrared signals by an infrared transmitter integrated in the configuration unit. The signals are decrypted in the display electronics for the motor vehicle license number, for which purpose a corresponding decryption software is stored in the display electronics.

From US 2007/0285361 A1, a system for wireless electronic motor vehicle license numbers is known. The inputting of data into the electronic motor vehicle license number is only possible for persons authorized to do this, namely with the aid of a secret code.

By comparison, the invention is based on the object of creating an improved motor vehicle electronics device and a corresponding motor vehicle, a method for displaying data on a motor vehicle display apparatus and a computer program product.

The objects on which the invention is based are in each case achieved by means of the features of the independent patent claims. Embodiments of the invention are specified in the dependent patent claims.

According to embodiments of the invention, the motor vehicle electronics device has a first interface for establishing a first connection to a first ID token in order to read data from the first ID token. The first ID token can be a document, particular a document of value or security into which an electronic memory and an interface for the establishment of the connection to the first interface of the motor vehicle electronics device are integrated. In particular, an RFID chip, in which the data are stored, can be integrated into the document.

According to the invention, a "document" is understood to be paper-based and/or plastic-based documents such as, for example, identification documents, particularly passports, identity cards, visa and driving licenses, vehicle registration documents, vehicle certificates of title, company identification cards, health insurance cards or other ID documents such as official ID cards and chip cards, payment cards, particularly bank cards and credit cards, freigh bills or other proofs of authority into which a data memory is integrated for storing at least one attribute.

The document can preferably be an electronic vehicle registration document or certificate of title or another motor vehicle document.

The motor vehicle electronics device has a memory for storing a certificate of a public key infrastructure (PKI). For example, the certificate can correspond to the X.509 standard. Furthermore, a so-called root certificate of this PKI can be stored in the same memory or in another memory of the motor vehicle electronics device. The certificate and the root certificate have typically a limited period of validity which is specified in the certificate or the root certificate, respectively.

The motor vehicle electronics device also has means for the authentication with respect to the first ID token using the certificate. For example, the authentication takes place by using a challenge-response method. For this purpose, the motor vehicle electronics device transmits its certificate via the first connection to the first ID token. The latter generates a challenge, for example in the form of a pseudo random number which the first ID token encrypts with the public key of the certificate and transmits the enciphered text via the first connection to the motor vehicle electronics device. The motor vehicle electronics device must then have the private key allocated to the certificate in order to be able to decrypt these encrypted data correctly.

It can be optionally provided that the first ID token must also authenticate itself with respect to the motor vehicle electronics device before the data are read from the first ID token. This can occur analogously to the authentication of the motor vehicle electronics device with respect to the ID token. For example, the procedure is thus that the ID token transmits its certificate to the motor vehicle electronics device via the first connection and thereafter the challenge-response method is carried out. To check the validity of the certificate of the first ID token, the motor vehicle electronics device can use the root certificate.

The motor vehicle electronics device has means for actuating at least one display apparatus for reproducing the data. For example, there are two display apparatuses which are arranged at the front and the rear of a motor vehicle instead of the usual license plates. The display devices can be constructed as displays, it being possible to use various display technologies.

For example, the display devices are constructed in such a manner that the data can also be displayed without continuous power supply. Such display apparatuses only require electrical energy when the data to be displayed change.

These are, for example, bi-stable displays such as, for example, electrophoretic displays, electrochromic displays, rotating element displays, ferroelectric displays, displays based on the electrowetting effect and bi-stable LCD displays, for example twisted nematic, super twisted nematic, cholesteric or nematic LCD displays. They can also be hybrid displays which combine various ones of these display technologies with one another.

Furthermore, flexible bi-stable displays which can be obtained commercially from the company Citala are known from the prior art. Such displays are also known from US 2006/0250534 A1. Further bi-stable electrophoretic displays are known, for example, from WO 99/53371 and EP 1 715 374 A1.

Bi-stable displays are also called "electronic paper displays" (EPDs).

Such bi-stable displays generally have the advantage that they can be read very easily in bright illumination and that no power supply is required for reproducing image data remaining constant over a long period.

Emissive display apparatuses can also be used which need a power supply for reproducing the data. These can be, for example LED displays, in particular anorganic, organic or hybrid LED displays. The display apparatus can also be implemented on the basis of an electroluminescent medium as is known per se, for example, from US 2002/0079494 A1 and U.S. Pat. No. 6,091,194.

The display apparatus can also be applied by printing technology and thus form an intimate and undetachable connection with the motor vehicle or parts of the motor vehicle, respectively. The production of, for example, TFTs for producing such display apparatuses by direct application with the aid of printing technology is known per se from WO 03/098696 A1.

The motor vehicle electronics device also has a second interface for storing the certificate in the memory. It is thus possible to access the memory of the motor vehicle electronics device via the second interface in order to transmit the certificate there and to store it, for example in order to enter the certificate for the first time in the memory in the case of a new motor vehicle or in order to update the certificate.

According to one embodiment of the invention, the data which are read from the first ID token via the first interface contain the official motor vehicle license number for the motor vehicle. For example, the motor vehicle license number has changed due to a re-registration at a motor vehicle registration center. The altered motor vehicle license number is stored in the first ID token by the registration center. This can be done online in that a secure connection, via which the data with the new motor vehicle license number are written into the first ID token, is established between the first ID token and a server computer. Such a secure connection can be implemented, for example, by means of end-to-end encryption via a client computer to which a reader for the first ID token is connected. The data with the new official motor vehicle license number can be signed by the motor vehicle registration center.

Embodiments of the present invention are particularly advantageous since complete electronic handling of the updating of the official motor vehicle license number is made possible. In particular, it is no longer necessary to produce and attach new license plates. As a result, resources can be saved to a considerable extend and waste can be avoided. Furthermore, the visits to the authorities hitherto associated with the issuance of new motor vehicle license plates are also unnecessary.

Embodiments of the present invention are particularly advantageous since the updating of the official motor vehicle license number by transmitting the data from the first ID token to the motor vehicle electronics device takes place in a particularly secure manner with maximum comfort for the user.

This is achieved by using cryptographic methods based on a PKI, for example for the unilateral or mutual authentication of the motor vehicle electronics device and of the first ID token and/or by checking the signature of the data received from the first ID token by the motor vehicle electronics device and/or by a cryptographic protection of the first connection via which the data are received by the motor vehicle electronics device from the first ID token.

According to one embodiment of the invention, the first interface of the motor vehicle electronics device is constructed to be contactless, for example as a radio interface, particularly as a contactless interface which operates in accordance with an RFID method. In particular, the first interface can be constructed in such a manner that an electronic key of the motor vehicle is also addressed via it. The electronic key can be, for example, a chip card such as, for example, an RFID chip card. However, there can also be a further interface for communicating with the electronic key, especially an RFID interface.

According to one embodiment of the invention, the second interface of the motor vehicle electronics device is constructed to have contacts. For example, the second interface is provided for connecting a cable. In particular, the motor vehicle electronics device can be constructed as a so-called electronic control unit (ECU) of the motor vehicle. For diagnostic and/or maintenance purposes, the ECU is connected to an external device, for example a terminal, a motor vehicle workshop or a technical test station. Via this cable, a connection can then be established between the external device and the ECU via which the certificate can be stored in the memory in order to update it, for example. This can be carried out, for example, during a maintenance of the motor vehicle or during a so-called major examination of the motor vehicle.

According to one embodiment of the invention, the second interface is provided for forming a network connection which can be carried out with contacts or contactlessly. For example, the second interface is constructed as a mobile radio interface in accordance with a mobile radio standard so that the certificate can be received via mobile radio.

According to one embodiment of the invention, an unambiguous motor vehicle identifier which is stored in the motor vehicle electronics device is first requested via the second interface. The motor vehicle identifier can be, for example, the chassis number of the motor vehicle. Using this motor vehicle identifier, a certificate is then generated or called up which belongs to the relevant motor vehicle.

According to one embodiment of the invention, the first interface is constructed for communication with a second ID token. The second ID token is used as access control for the motor vehicle. Possession of the second ID token is a prerequisite for the motor vehicle to be allowed to be opened and/or started by the user. For example, the second ID token is an RFID chip card which is used as electronic key ("E-key").

In the second ID token, a key identifier is stored. This key identifier is requested from the second ID token by the motor vehicle electronics device via its first interface. If the key identifier received via the first interface from the second ID token matches a reference value of the key identifier stored in the motor vehicle electronics device, the motor vehicle electronics device generates a signal, for example for unlocking the central locking system of the motor vehicle and/or enabling starting of the engine of the motor vehicle.

Instead of the first interface, there can also be a further interface for the communication between the motor vehicle electronics device and the second ID token, e.g. a further RFID interface which has a greater range than the first interface. The range of the further interface is selected in such a manner that the second ID token is detected by the motor vehicle electronics device when the second ID token is still outside the motor vehicle whereas the range of the first interface is selected in such a manner that the first ID token must be located within the internal space of the motor vehicle so that the first connection can be established. Thus, the prerequisite for updating the motor vehicle license number is then that the user must first unlock the motor vehicle and enter.

Preferably, it is not the motor vehicle identifier which is selected as key identifier. This has the advantage that in the case of a loss of the second ID token, this second ID token can be replaced by another one in that another key identifier is stored. The second interface of the motor vehicle electronics device is preferably constructed in such a manner that it is possible to access this through the memory area of the motor vehicle electronics device in which the key identifier is stored in order to replace the key identifier, stored there, of the lost second ID token by the new key identifier of the new second ID token. For example, the new key identifier is signed, the motor vehicle electronics device checking the validity of the signature before the old key identifier is replaced by the new key identifier.

According to one embodiment of the invention, the motor vehicle electronics device has means for establishing a secure data transmission channel for actuating the at least one display apparatus. For example, the data transmission via this data transmission channel is encrypted in order to prevent manipulation of the actuation of the at least one display apparatus.

In a further aspect, the invention relates to a motor vehicle with an embodiment of the motor vehicle electronics device according to the invention and at least one display apparatus visible from the outside, which is connected to the motor vehicle electronics device.

In a further aspect, the invention relates to a method for displaying data, for example an official license number, on a motor vehicle display apparatus, comprising the following steps: establishing a first connection between a motor vehicle electronics device and a first ID token, accessing a memory of the motor vehicle electronics device for reading a certificate, cryptographically authenticating the motor vehicle electronics device with respect to the ID token by using the certificate, reading out data from the first ID token via the first connection after the authentication of the motor vehicle electronics device with respect to the first ID token has been carried out successfully, actuating the motor vehicle display apparatus for reproducing the data.

In a further aspect, the invention relates to a computer program product comprising program instructions, which can be executed by a motor vehicle electronics device, for displaying data on a motor vehicle display apparatus.

Figure 2:
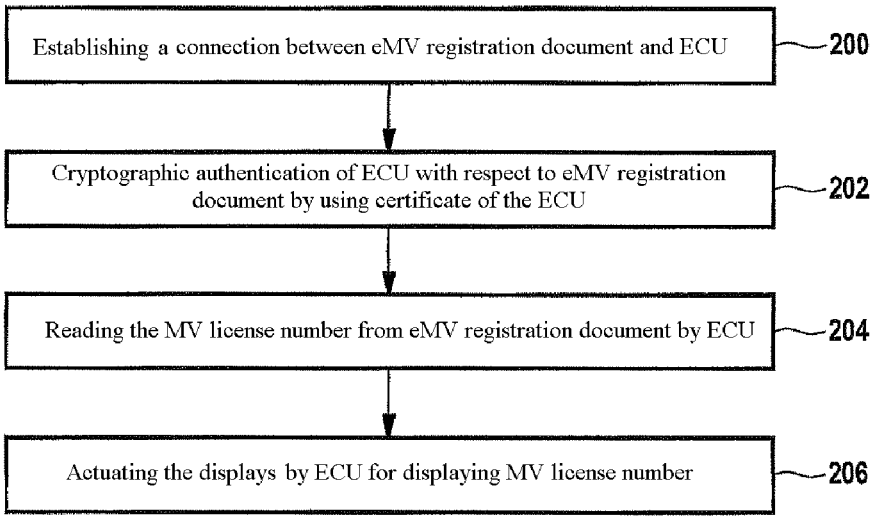
Figure 3:
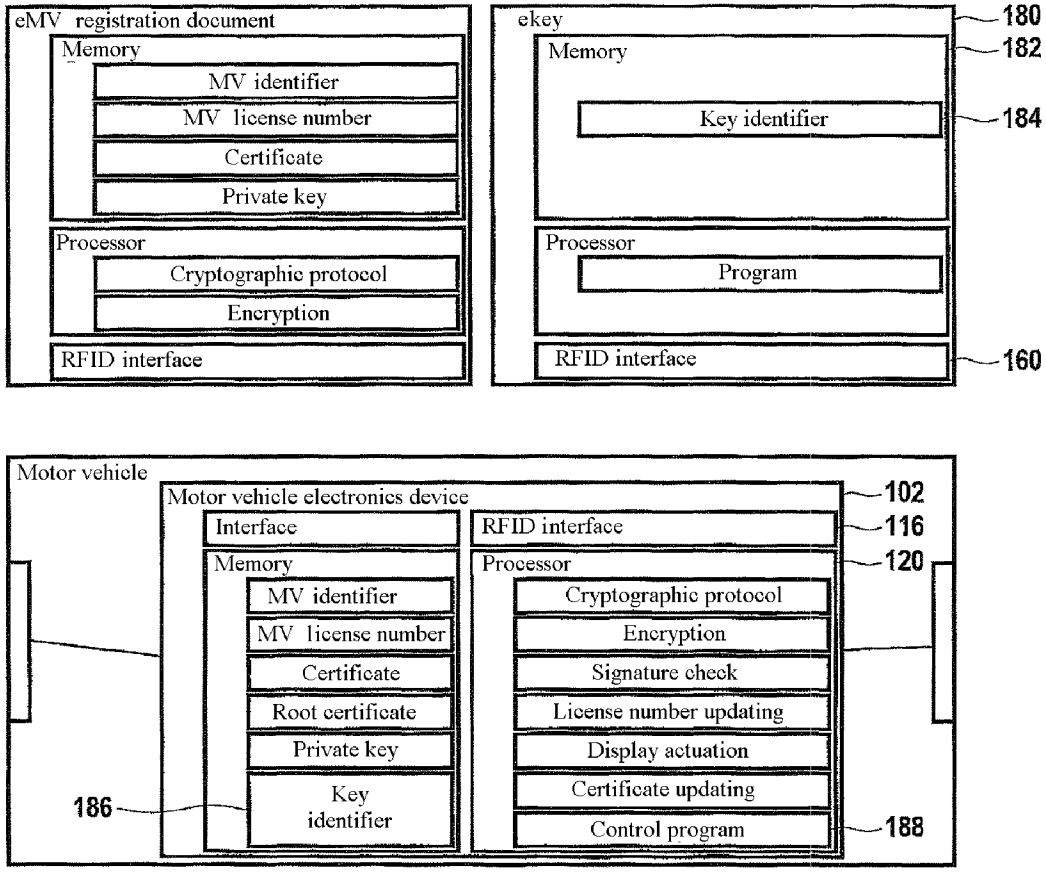

In the further text, embodiments of the invention are explained in greater detail with reference to the drawings, in which:

FIG. 1 shows a block diagram of a first embodiment of a motor vehicle electronics device according to the invention and of a motor vehicle according to the invention, FIG. 2 shows a flow chart of an embodiment of a method according to the invention, and FIG. 3 shows a block diagram of a further embodiment of a motor vehicle electronics device according to the invention and of a motor vehicle according to the invention.

Mutually corresponding elements of the following embodiments are in each case identified using the same reference symbols.

FIG. 1 diagrammatically shows a motor vehicle 100 such as, for example, a passenger car. The motor vehicle 100 has at least one motor vehicle electronics device 102 which, for example, can be constructed as a so-called electronic control unit (ECU).

The motor vehicle electronics device 102 has an electronic memory 104 with at least the memory areas 106, 108, 110, 112 and 114. Memory area 106 is used for storing a motor vehicle identifier, i.e. a so-called unique identifier such as, for example, the chassis number of the motor vehicle 100. The memory area 106 is preferably arranged in such a manner that the motor vehicle identifier stored there cannot be changed so that the motor vehicle electronics device 102 is thus permanently allocated to the motor vehicle 100.

The memory area 108 is used for storing data which contain the official motor vehicle license number of the motor vehicle 100. These data can be updated via an interface 116 of the motor vehicle electronics device 102. In the embodiment considered here, the interface 116 is constructed contactlessly as a radio interface which operates in accordance with an RFID method.

Memory area 110 is used for storing a certificate of the motor vehicle 100, wherein the certificate can be, for example, a standardized certificate of a PKI. Memory area 112 is used for storing a so-called root certificate of the PKI.

In memory area 114 of the memory 104, the private key of the motor vehicle 100 belonging to the certificate 110 is stored. In principle, this memory area 114 cannot be accessed externally via the interface 116 or via a further interface 118 of the motor vehicle electronics device 102.

Interface 118 is constructed, for example, with contacts for connecting a cable. Via interface 118, memory areas 110 and 112 can be accessed externally in order to update the certificate or the root certificate, respectively.

The motor vehicle electronics device 102 also has at least one processor 120 for executing program modules 122, 124, 126, 128, 130 and 132.

Program module 122 is used for executing the steps relating to the motor vehicle electronics device 102, of a cryptographic protocol for authenticating the motor vehicle electronics device 102 with respect to an ID token 134. The program module 122 is preferably constructed in such a manner that an authentication of the ID token 134 with respect to the motor vehicle electronics device 102 also takes place.

Program module 124 is used for encrypting data which are exchanged between the motor vehicle electronics device 102 and the ID token 134. In this process, an encryption with a symmetric or an asymmetric key can take place.

Program module 126 is used for carrying out a signature check of an electronic signature received from the ID token 134. For this purpose, the program module 126 accesses the memory area 112 for calling up the root certificate there.

Program module 128 is started for updating the data stored in memory area 108, which data contain the official motor vehicle license number. Program module 130 is used for driving displays 136 and 138 of the motor vehicle 100. Displays 136 and 138 can be arranged there at the motor vehicle 100 where usually the license plates are arranged. Displays 136 and 138 are connected to the motor vehicle electronics device 102 via secure data transmission channels 140 and 142, respectively. For example, the data transmission channels 140 and/or 142 can be implemented via a bus system of the motor vehicle 100.

Program module 132 is started in order to update the certificate stored in memory area 110 and/or the root certificate stored in memory area 112 via the interface 118.

The motor vehicle electronics device 102 can be implemented as a system consisting of a number of spatially separate electronic components which, for example, are connected to one another via a bus system of the motor vehicle 100. Correspondingly, memory 104 can also be implemented distributed over various such components which altogether form the motor vehicle electronics device 102. This correspondingly applies to processor 120.

The ID token 134 has an electronic memory 144 with protected memory areas 146, 148, 150 and 152. Memory area 146 is used for storing the motor vehicle identifier, which is also stored in memory area 106 of the memory 104 of the motor vehicle electronics device 102. By this means, the ID token 134 is unambiguously allocated to the motor vehicle 100. In memory area 146, a signature of the motor vehicle identifier can be additionally stored.

In memory area 148, data are stored which contain the current official motor vehicle license number of the motor vehicle 100. In addition, a digital signature of these data can be stored in memory area 148. These data can have been written into memory area 148 by a server computer of the motor vehicle registration center.

Memory area 150 is used for storing a certificate of the ID token 134. Memory area 152 is used for storing a private key to which the certificate stored in memory area 150 is allocated.

The ID token 134 also has a processor 154 for executing program modules 156 and 158 which correspond to program modules 122 and 124. Program module 156 is used for executing the steps of the cryptographic protocol relating to the ID token 134. Program module 158 is used for establishing the encrypted connection to the motor vehicle electronics device 102, especially a connection with end-to-end encryption with the aid of a symmetric or asymmetric key.

The ID token 134 also has an interface 160 which corresponds to the interface 116 of the motor vehicle electronics device 102 and which is constructed, for example, as a radio interface which operates in accordance with an RFID method.

The ID token 134 can be a document such as, for example, an electronic vehicle certificate of title or an electronic vehicle registration document as shown in FIG. 1. The document can be designed, for example, to be card-shaped.

The motor vehicle electronics device 102 can be connected to a terminal 162 via its interface 118. Terminal 162 has an interface 164 which corresponds to the interface 118 of the motor vehicle electronics device 102. Interfaces 164 and 118 can be connected, for example, by means of a cable, for which purpose the engine hood of the motor vehicle 100 must be typically opened.

Terminal 162 has at least one processor 166 for executing a program 168 and a network interface 170 for communicating with a server computer 172 via a network 174.

The server computer 172 provides a certificate provider, for example in the form of a database 176, in which the current certificates for various motor vehicles are stored. In this context, the respective motor vehicle identifier is used as access key for the certificates stored in database 176. In addition, the server computer 172 can also supply an updated root certificate 178.

When the motor vehicle 100 is operated, memory area 108 is accessed by executing the program module 130 in order to read therefrom the data by means of which displays 136 and 138 are driven via the data transmission channels 140 and 142, respectively, for reproducing the motor vehicle license number.

To update the motor vehicle license number, the following procedure is adopted:

1. Firstly, the user, i.e. the owner of motor vehicle 100, for example, calls up an online service of a server computer, for example of a motor vehicle registration authority. This can be done via a personal computer of the owner via the internet. The personal computer has a reader for communication with the ID token 134. Via the personal computer and its reader, a secure connection to the server of the motor vehicle registration center is established via which the data with the current motor vehicle license number and possibly the signature for said data are written into the memory area 146 of the ID token 134.
2. When the user with the ID token 134 is located within the range of reception of the interface 116, the program module 128 is started in order to update the motor vehicle license number. This can be done manually in that the user operates an operating element of the motor vehicle 100 which, for example, can be arranged on the instrument panel of the motor vehicle 100. However, program module 128 can also be executed continuously. By executing program module 128, signals are sent out cyclically within certain time intervals by the interface 116 in order to check whether the ID token 134 is located within the range of reception of the interface 116.

The motor vehicle license number is then updated in such a manner that a connection is established between interfaces 116 and 160. For example, program module 128 accesses the certificate stored in memory area 110 in order to send it from interface 116 to the ID token 134. Program module 156 of the ID token 134 then generates a so-called challenge, i.e., for example, a pseudo-random number. This pseudo-random number is encrypted with the public key, contained in the certificate, of the motor vehicle 100.

The resultant enciphered text is transmitted by the ID token 134 via the connection to the interface 116 of the motor vehicle electronics device 102. Program module 122 decrypts the enciphered text with the aid of the private key, stored in memory area 114, of the motor vehicle 100 and thus obtains the pseudo-random number. This pseudo-random number is sent back by the program module 122 to the ID token 134 via the interface 116.

By executing program module 156, a check is made there whether the pseudo-random number received by the motor vehicle electronics device 102 corresponds to the originally generated pseudo-random number, i.e. the challenge. If this is so, the motor vehicle electronics device 102 is considered to be authenticated with respect to the ID token 134. The pseudo-random number can be used as symmetric key for the end-to-end encryption which is carried out by program modules 124 and 158, respectively.

Analogously, the ID token 134 can be optionally authenticated with respect to the motor vehicle electronics device 102.

The unilateral or mutual authentication can also include the motor vehicle identifier, which is stored in memory areas 106 and 146, respectively. For example, ID token 134 transmits the motor vehicle identifier signed by the ID token 134 to the motor vehicle electronics device 102. The motor vehicle electronics device 102 then checks the signature and compares the motor vehicle identifier received from the ID token 134 with the motor vehicle identifier stored in memory area 106. If the signature is valid and the motor vehicle identifiers match, ID token 134 is considered to be authentic.
3. Once the unilateral or mutual authentication of the motor vehicle electronics device 102 and of the ID token 134 has taken place, the motor vehicle electronics device 102 receives a read authorization for accessing the memory area 148 of the ID token 134. Program module 128 then transmits a corresponding read command from the interface 116 to the ID token 134. The ID token 134 thereupon reads the data, possibly including the signature, out of memory area 148 and transmits it via the connection with end-to-end encryption to the interface 116. Program module 128 then starts program module 126 in order to check the signature of the data with the aid of the root certificate 112. If the signature is valid, the data are stored in memory area 108 during which process the data previously stored there can be overwritten. Program module 130 then drives the displays 136 and 138 with these updated data so that the updated official license number is reproduced on displays 136 and 138.

To update the certificates stored in memory areas 110 and 112, the following procedure is adopted:

A connection is established between interfaces 118 and 164, for example via a cable. By executing program 168, the motor vehicle identifier is read out of memory area 106 of the motor vehicle electronics device 102. Program 168 then generates a request for the server computer 172 which contains this motor vehicle identifier.

This request is transmitted by terminal 162 from its network interface 170 via network 174 to the server computer 172. On the basis of this request, the server computer accesses the database 176 in order to read out the current certificate allocated to the motor vehicle identifier with the aid of the motor vehicle identifier. The certificate and the current root certificate 178 are transmitted from the server computer 172 via network 174 to terminal 162 and are transmitted from there via the connection between the interface 164 and the interface 118 by execution of program 168 to the motor vehicle electronics device, where the current certificate is stored in memory area 110 and the current root certificate is stored in memory area 112 by overwriting the certificates in each case previously stored there.

The terminal can belong, for example, to a workshop which updates the certificates in this manner on the occasion of routine maintenance of the motor vehicle 100. The terminal can also belong to a test center such as, for example, the Technical Inspection Agency (TÜV) which updates the certificates on the occasion of a so-called major examination.

In an alternative embodiment, the interface 118 is constructed in such a manner that it can communicate directly with the server computer 172 such as, for example, via a mobile radio link.

FIG. 2 shows a flow chart of an embodiment of a corresponding method according to the invention.

In step 200, a connection is established between the ID token, i.e., for example, the electronic motor vehicle registration document, and the motor vehicle electronics device, for example an ECU of the motor vehicle. This can take place automatically as soon as the electronic motor vehicle registration document is located within range of the RFID interface of the motor vehicle electronics device (compare interface 116 in the embodiment of FIG. 1).

In step 202, at least one unilateral cryptographic authentication of the ECU with respect to the electronic motor vehicle registration document takes place, using the certificate of the ECU for this purpose. In addition to the cryptographic authentication, the motor vehicle identifiers stored in each case in the electronic motor vehicle registration document and the ECU can also be checked for correspondence.

After the cryptographic authentication, the current official motor vehicle license number is read out of the electronic motor vehicle registration document by the ECU in step 204, and in step 206, the displays are driven by the ECU for displaying the new motor vehicle license number.

FIG. 3 shows a further embodiment of the invention. In addition to the embodiment of FIG. 1, the interface 116 of the motor vehicle electronics device 102 is constructed for communicating with a corresponding interface 160 of a further ID token 180. ID token 180 may be designed, for example, as an electronic key. ID token 180 has a memory 182 for storing a key identifier 184 of the ID token 180. The key identifier is an identifier by means of which the ID token 180 is unambiguously or almost unambiguously identified.

A reference value for this key identifier 184 is stored in a memory area 186 of the motor vehicle electronics device 102.

Processor 120 of the motor vehicle electronics device 102 is here used additionally to execute a control program 188.

By executing the control program 188, signals are cyclically emitted by the interface 116. When the ID token 180 is within range of the interface 116, the ID token 180 responds to such a signal by transmitting the key identifier 184 to interface 116. The control program 188 then checks the key identifier 184 received via the interface 116 with the reference value stored in memory area 186. In the case of a match, control program 188 drives a central locking system of the motor vehicle 100 in order to release the opening of the doors. As an alternative or in addition, control program 188 can enable actuation of the starter of the motor vehicle 100.

If, in addition to the ID token 180, ID token 134 is also within range of the interface 116, the control program 188 starts program module 128 for updating the license number.

LIST OF REFERENCE DESIGNATIONS

100 Motor vehicle
102 Motor vehicle electronics device
104 Memory
106 Memory area
108 Memory area
110 Memory area
112 Memory area
114 Memory area
116 Interface
118 Interface
120 Processor
122 Program module
124 Program module
126 Program module
128 Program module
130 Program module
132 Program module
134 ID token
136 Display
138 Display
140 Data transmission channel
142 Data transmission channel
144 Memory
146 Memory area
148 Memory area
150 Memory area
152 Memory area
154 Processor
156 Program module
158 Program module
160 Interface
162 Terminal
164 Interface
166 Processor
168 Program
170 Network interface
172 Server computer
174 Network
176 Database
178 Root certificate
180 ID token
182 Memory
184 Key identifier
186 Memory area
188 Control program

We claim:

1. A motor vehicle electronics device comprising:

a first interface for establishing a first connection to a first ID token in order to read data from the first ID token, wherein the first ID token is a paper-based and/or plastic-based document into which an electronic memory and an interface for the establishment of the connection to said first interface of said motor vehicle electronics device are integrated, wherein the first connection is a wireless connection, a memory for storing a digital certificate issued to the motor vehicle electronics device, wherein the motor vehicle electronics device is capable of cryptographically authenticating itself against the first ID token using the certificate, the authentication comprising:

transmitting the digital certificate to the first ID token; and responding to a challenge received from the first ID token, the challenge dependent upon a public encryption key of the digital certificate and the response dependent upon a private encryption key corresponding to the public encryption key, wherein the motor vehicle electronics device is capable of actuating at least one display apparatus for reproducing the data, and wherein data is read from the first ID token and the at least one display apparatus is actuated to reproduce the data only when the motor vehicle electronic device is authenticated; and wherein said motor vehicle electronics device is constructed for establishing a second connection to a second ID token, the second ID token comprising an RFID chip card to be used as an electronic key, and wherein actuation of the at least one display apparatus for reproducing the data from the first ID token only occurs when the second connection can be established.

2. The motor vehicle electronics device as claimed in claim 1, wherein the data contain a motor vehicle license number.

3. The motor vehicle electronics device as claimed in claim 1, wherein the first interface is constructed to be contactless.

4. The motor vehicle electronics device as claimed in claim 3, wherein the first interface is constructed as a radio interface.

5. The motor vehicle electronics device as claimed in claim 1, further comprising a second interface for storing the certificate in the memory, wherein the second interface is constructed to have contacts.

6. The motor vehicle electronics device as claimed in claim 1, further comprising a second interface for storing the certificate in the memory, wherein the second interface is constructed as a network interface, particularly as a mobile radio interface.

7. The motor vehicle electronics device as claimed in claim 6, wherein an identifier is stored in the motor vehicle electronics device and wherein the second interface is constructed for reading out the identifier.

8. The motor vehicle electronics device as claimed in claim 6, wherein the second connection is used for reading a key identifier from a second ID token and wherein a reference value for the key identifier is stored in the motor vehicle electronics device.

9. The motor vehicle electronics device as claimed in claim 1, additionally capable of establishing a secure data transmission channel for actuating the at least one display apparatus, wherein the display apparatus is not integrated with the motor vehicle electronics device.

10. A motor vehicle comprising a motor vehicle electronics device as claimed in claim 1 and comprising at least one display apparatus which is constructed for actuation by the motor vehicle electronics device.

11. The motor vehicle as claimed in claim 10, capable of establishing a secure data transmission channel between the motor vehicle electronics device and the at least one display apparatus, wherein the display apparatus is not integrated with the motor vehicle electronics device.

12. The motor vehicle electronics device as claimed in claim 1, wherein a root certificate is updated via the third connection.

13. The motor vehicle electronics device as claimed in claim 1, wherein the motor vehicle electronics device is constructed for establishing a third connection via the second interface, wherein the certificate is updated via the third connection, and wherein the third connection is a wired connection.

14. A method for displaying data on a motor vehicle display apparatus comprising the following steps:

establishing a first connection between a motor vehicle electronics device and a first ID token, wherein the first ID token is a paper-based and/or plastic-based document into which an electronic memory and an interface for the establishment of the connection to said first interface of said motor vehicle electronics device are integrated, accessing a memory of the motor vehicle electronics device for reading a certificate, cryptographically authenticating the motor vehicle electronics device with respect to the first ID token by using the certificate, the authentication comprising:

transmitting the certificate to the first ID token; and responding to a challenge received from the first ID token, the challenge dependent upon a public key of the certificate and the response dependent upon a private key corresponding to the public key, reading out data from the first ID token via the first connection only when the authentication of the motor vehicle electronics device with respect to the first ID token has been carried out successfully, and actuating the motor vehicle display apparatus for reproducing the data from the first ID token, wherein the at least one display apparatus is actuated for reproducing the data from the first ID token only when the authentication of the motor vehicle electronics device with respect to the first ID token has been carried out successfully and the second connection can be established; and wherein said motor vehicle electronics device is constructed for establishing a second connection to a second ID token, the second ID token comprising an RFID chip card to be used as an electronic key, and wherein actuation of the at least one display apparatus for reproducing the data from the first ID token only occurs when the second connection can be established.

15. The method as claimed in claim 14, wherein a third connection, via which the certificate and/or a root certificate is updated, is established via a second interface of the motor vehicle electronics device.

16. The method as claimed in claim 14, wherein a second connection, between the motor vehicle electronics device and a second ID token, is used for reading out a key identifier from the second ID token, wherein the second token comprises an RFID chip card to be used as an electronic key and wherein a reference value for the key identifier is stored in the motor vehicle electronics device.

17. A non-transitory computer readable medium comprising program instructions, the instructions executed by a motor vehicle electronics device and comprising the following steps:

establishing a first connection between a motor vehicle electronics device and a first ID token, wherein the first ID token is a paper-based and/or plastic-based document into which an electronic memory and an interface for the establishment of the connection to said first interface of said motor vehicle electronics device are integrated, accessing a memory of the motor vehicle electronics device for reading a certificate, cryptographically authenticating the motor vehicle electronics device with respect to the first ID token by using the certificate, the authentication comprising:

transmitting the certificate to the first ID token; and responding to a challenge received from the first ID token, the challenge dependent upon a public key of the certificate and the response dependent upon a private key corresponding to the public key, reading out data from the first ID token via the first connection only when the authentication of the motor vehicle electronics device with respect to the first ID token has been carried out successfully, establishing a second connection to a second ID token, wherein the second ID token is an RFID chip card to be used as an electronic key, actuating the motor vehicle display apparatus for reproducing the data from the first ID token, wherein the at least one display apparatus is actuated for reproducing the data from the first ID token only if the second connection can be established and the authentication of the motor vehicle electronics device with respect to the first ID token has been carried out successfully.

18. The computer readable medium as claimed in claim 17, wherein a third connection, via which the certificate and/or a root certificate is updated, is established via a second interface of the motor vehicle electronics device.

* * * * *